US008864240B2

(12) United States Patent
Hach

(10) Patent No.: US 8,864,240 B2
(45) Date of Patent: Oct. 21, 2014

(54) VERTICAL OR HORIZONTAL ROBOT FOR HYDRODEMOLITION OF CONCRETE

(75) Inventor: William Hach, Baltimore, MD (US)

(73) Assignee: Ash Equipment Company, Inc.

( * ) Notice: Subject to any disclaimer, the term of this patent is extended or adjusted under 35 U.S.C. 154(b) by 537 days.

(21) Appl. No.: 12/923,393

(22) Filed: Sep. 20, 2010

(65) Prior Publication Data

US 2012/0067184 A1 Mar. 22, 2012

(51) Int. Cl.
*B26F 3/00* (2006.01)
*E04G 23/08* (2006.01)

(52) U.S. Cl.
CPC .. *B26F 3/00* (2013.01); *E04G 23/08* (2013.01)
USPC ..... 299/17; 299/29; 299/30; 239/225.1; 239/587.4

(58) Field of Classification Search
USPC ..... 299/17, 29, 30; 239/750–752, 225.1, 239/587.4
See application file for complete search history.

(56) References Cited

U.S. PATENT DOCUMENTS 5,203,442 A * 4/1993 Oury et al. ..... 198/313
5,265,741 A * 11/1993 Shimizu et al. ..... 212/177
5,609,260 A * 3/1997 Liao ..... 212/279
7,080,888 B2 * 7/2006 Hach ..... 299/17

OTHER PUBLICATIONS

Ortiz, B., "San Vicente Dam", Sep. 24, 2009, <http://www.youtube.com/watch?v=Xxam9k4mAmE &list=PL9D8876DBB3CBB444>.*
Ortiz, B., "San Vicente Dam/ Hydro Demolition", Dec. 8, 2009, <http://www.youtube.com/watch?v=Jn-0fylls7w &list=PL9D8876DBB3CBB444>.*
Ortiz, B., "San Vicente Reservoir/ Dam Rise Project", Feb. 2, 2010, <http://www.youtube.com/watch?v=E-PPDgL-sxc &list=PL9D8876DBB3CBB444>.*
Fraco Products Ltd., "Fraco Involved in the Tallest Dam Raise in the United States", Jun. 24, 2010, <http://www.masoncontractors.org/2010/06/24/fraco-involved-in-the-tallest-dam-raise-in-the-united-states/>.*

* cited by examiner

*Primary Examiner* — John Kreck
*Assistant Examiner* — Carib Oquendo
(74) *Attorney, Agent, or Firm* — H. Jay Spiegel

(57) ABSTRACT

A boom is made of telescoping boom sections. A movable cutting nozzle is on the boom and sprays water. In one embodiment, the boom is coupled to the climber section of a platform that climbs a tower. A further beam is mounted on the other side of the hydraulic elevating platform and carries a movable power pack/counterweight. In a second embodiment of the present invention, the device is oriented horizontally and the platform moves horizontally on a rail. In this configuration, the elongated boom has a distal end protruding over the top edge of a dam or other structure. Depending vertically from the boom is another vertical boom carrying the cutting nozzle. This boom travels on the outer boom section of the elongated boom and extends downwardly a distance to allow the device to treat the concrete surface downward from the top edge of the structure.

20 Claims, 18 Drawing Sheets

VERTICAL OR HORIZONTAL ROBOT FOR HYDRODEMOLITION OF CONCRETE

BACKGROUND OF THE INVENTION

The present invention relates to a vertical or horizontal robot for hydrodemolition of concrete. Many dams are made of steel reinforced concrete. This material has a finite service life and as that time period is approached, signs emerge that the useful life has arrived. Such signs include formation of cracks, crumbling, and pieces separating from one another and falling from the structure.

When it is time to repair such a dam, it is necessary to efficiently remove the concrete from its steel reinforcement and pour fresh concrete in its place. To perform such an operation, one must take into account the fact that such dams are often hundreds of feet tall and hundreds of feet wide with lengthy vertical, horizontal and/or angled surfaces. In order to perform such concrete removal, it is necessary to use heavy duty machinery that can traverse the height and width of the surface that is to be removed. Moreover, as mentioned above, the surface in question may be angled with respect to the vertical or it may be vertical or even include horizontal aspects. The sheer scale of such a project requires machinery of uncommon efficiency, otherwise, the economic feasibility diminishes and the amortization of the dam itself becomes shortened.

As such, a need has developed for a hydrodemolition device that can efficiently operate in the environment of the surface of a dam and cleanly, efficiently, and quickly demolish the concrete facade so that it can be replaced, thereby replenishing the dam and extending its useful life. It is with these needs in mind that the present invention was developed.

SUMMARY OF THE INVENTION

The present invention relates to a vertical or horizontal robot for hydrodemolition of concrete. The present invention includes the following interrelated objects, aspects and features:

(1) In a first aspect, the present invention includes a generally horizontal elongated boom made of inner and outer boom sections. The outer boom section is slidably mounted over the inner boom section and is moved inward and outward by virtue of a gear and rack mechanism, with the gear rotated by a hydraulically actuated motor. A cutting nozzle is carried on the outer boom section and may also traverse back and forth along the length of the outer boom using a similar gear and rack mechanism, with the gear coupled to the drive shaft of an additional hydraulic motor.

(2) The cutting nozzle is connected to a source of high pressure water, with that source including a heavy duty pump. If desired, the cutting nozzle may oscillate or rotate while in use and while it traverses the length of the outer boom section back and forth. The cutting nozzle may also comprise a plurality of nozzles supplied independently or via a manifold.

(3) In one embodiment, the inner boom section is releasably coupled to the climber section of an elevating platform. The elevating platform includes a first section surrounding a portion of an elongated tower affixed to the surface to be treated. The first section is coupled to the elongated tower in such a way that it may climb up the tower and also descend on the tower. Such a device is manufactured, for example, by Fraco and is known as their hydraulic elevating platform. A further beam is mounted on the other side of the hydraulic elevating platform and carries a power pack. The power pack is mounted on its beam by an interconnection allowing the power pack to traverse back and forth along the beam on which it is mounted using a gear and rack mechanism with the gear coupled to the drive shaft of a hydraulic motor. A counterweight is affixed to the power pack and moves with it. The power pack and counterweight are movable together to facilitate balancing the weight of the inventive robot to either side of the hydraulic elevating platform. This is an important and essential feature because imbalances in weight distribution to either side of the hydraulic elevating platform can cause it to bind up in its elongated tower and thereby preclude vertical movements with respect to the elongated tower.

(4) The power pack includes an engine that when activated provides power for pumps to supply pressurized hydraulic fluid through a series of hoses and valves to operate the system. Controls on the power pack that control the various valves and pumps are easily accessible to an operator who can stand on a platform in front of the power pack and gain access to all of the necessary controls. The water supply pumps are typically mounted on a separate ground-based trailer that is connected to a source of water and supplies the water under pressure to the cutting nozzle via an elongated hose.

(5) The inner boom is mounted on the hydraulic elevating platform in such a manner that it may move vertically with respect to the hydraulic elevating platform while the hydraulic elevating platform also can move with respect to the elongated tower.

(6) A stabilizing roller is provided at the distal end of the outer boom section and includes a hydraulic cylinder actuator to allow it to move in and out. The purpose for the stabilizing roller is to engage the concrete surface that is being treated with the cutting nozzle to stabilize the device in operative position.

(7) If desired, the high pressure water nozzle of the preferred embodiment can easily be replaced with a sand blast nozzle, a wash down nozzle, a water spray bar for cleaning purposes, painting nozzles or guns, a concrete saw, pneumatic hammers, or crack routers.

(8) The outer boom can be moved with respect to the inner boom and the cutting nozzle can be moved with respect to the outer boom to the point where work can be performed at a distance of 30 feet or more from the elongated tower. Additionally, the device can work with a single cutting nozzle or two or more cutting nozzles operating together.

(9) In a second embodiment of the present invention, the inventive device is oriented horizontally such that the hydraulic elevating platform in fact moves horizontally on a rail that is mounted, for example, on the top edge of a dam. In this configuration, the elongated boom is still horizontal but in this case extends perpendicularly to the top edge of the dam so that its distal extensible end protrudes over the top edge of the dam and may be extended in and out to take into account the angulation of the dam.

(10) Depending vertically from the elongated boom is another extensible vertical boom that carries at its end the cutting nozzle. This boom travels on the outer boom section of the elongated boom mentioned above and may extend downwardly a significant distance, for example, 25 feet or more, to allow the device to treat the concrete surface at least 25 feet downward from the top edge of the dam.

(11) The cutting nozzle is located at the end of the outer section of this vertical boom and can move up and down with the outer boom as well as moving with respect to the outer boom so that the entirety of the concrete surface of the dam from the top edge down to the vertical extent of the extendible vertical boom may be treated.

(12) The cutting nozzle can comprise a single nozzle or, as described above in paragraph 7, can be replaced with a sandblast nozzle, a wash-down nozzle, a water spray bar, painting nozzles or guns, a-concrete saw, pneumatic hammers or crack routers. In another aspect, it can be replaced with a multiple cutting nozzle device including an elongated manifold with a plurality of spaced nozzles allowing a long vertical swath of concrete surface to be simultaneously treated.

(13) In this embodiment of the present invention, the power pack with its counterweight may move horizontally in the same manner as in the first embodiment to counterbalance the load of the vertically depending extendible boom as that boom moves inward and outward with respect to the top edge of the dam. Of course, use of the inventive device with a dam is merely one contemplated environment of use, and other such environments may be contemplated such as bridges, roadways, berms, and the like.

Accordingly, it is a first object of the present invention to provide a vertical or horizontal robot for hydrodemolition of concrete.

It is a further object of the present invention to provide such a device in which a hydraulic elevating platform is mounted on the face of a concrete dam and booms are mounted to the elevating device to carry out the purposes of the present invention.

It is a still further object of the present invention to provide such a device in which the weight of components thereof to either side of the elevating tower is maintained in balance as much as possible to prevent binding of the device on the elongated tower.

It is a still further object of the present invention to provide such a device including a horizontally movable power pack carrying counterweights.

It is a yet further object of the present invention to provide such a device in which an outer boom structure moves with respect to an inner boom structure, with the outer boom structure carrying one or more cutting nozzles as well as a stabilizing roller.

It is a still further object of the present invention to provide such a device in which a robot may be mounted on a track for horizontal movement carrying an elongated boom and a power pack.

It is a yet further object of the present invention to provide such a device in which a vertically extendible boom is mounted on the horizontally elongated boom and carries a cutting nozzle.

It is a still further object of the present invention to provide such a device in which the cutting nozzle may be replaced with other choices including a spray bar having a plurality of nozzles and a manifold.

These and other objects, aspects and features of the present invention will be better understood from the following detailed description of the preferred embodiments when read in conjunction with the appended drawing figures.

SPECIFIC DESCRIPTION OF THE PREFERRED EMBODIMENT

Figure 1:
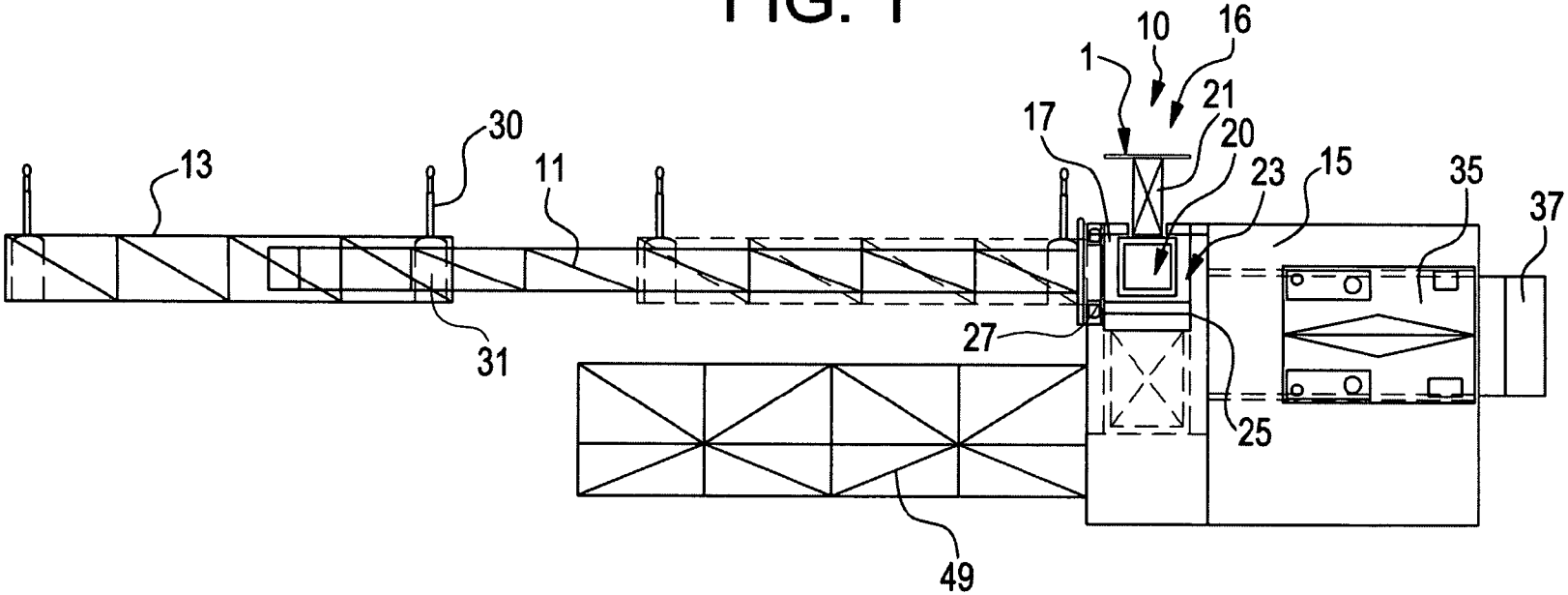
FIG. 1 shows a top view of a first embodiment of the present invention.
Figure 2:
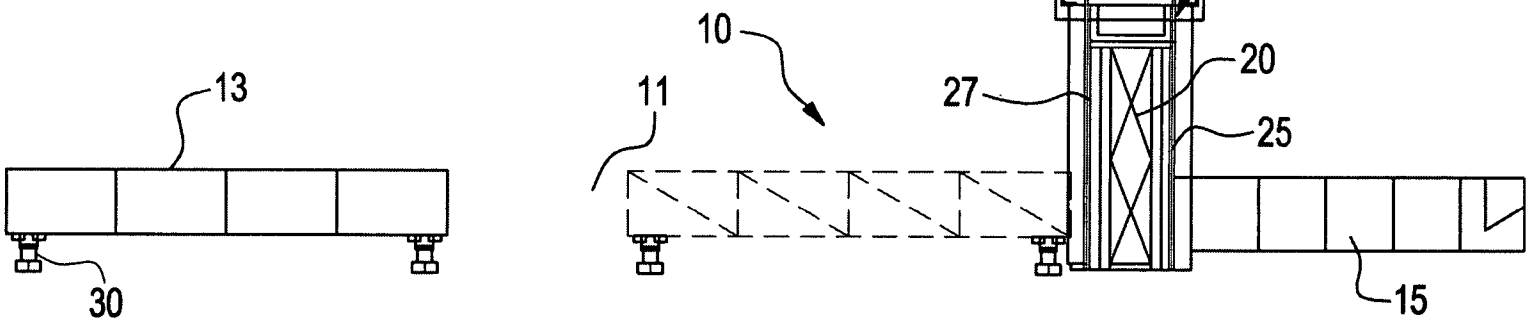
FIG. 2 shows a side view of a first embodiment of the present invention.

With reference, first, to FIGS. 1 and 2, a first embodiment of the present invention is generally designated by the reference numeral 10. It includes an inner boom section 11, an outer boom section 13, and a further boom section 15. The inner boom section 11 is releasably coupled to the climber section 17 of a hydraulic elevating platform 16. The hydraulic elevating platform 16 includes a tower section 20 that is elongated and mounted on a surface 1 to be operated upon by the inventive device 10 by a series of spaced elongated pedestals 21. The hydraulic elevating platform 16 includes an elevating unit 23 surrounding the elongated tower and having sides 25 and 27 that facilitate releasable coupling of the further boom section 15 and the inner boom section 11, respectively.

Figure 7:
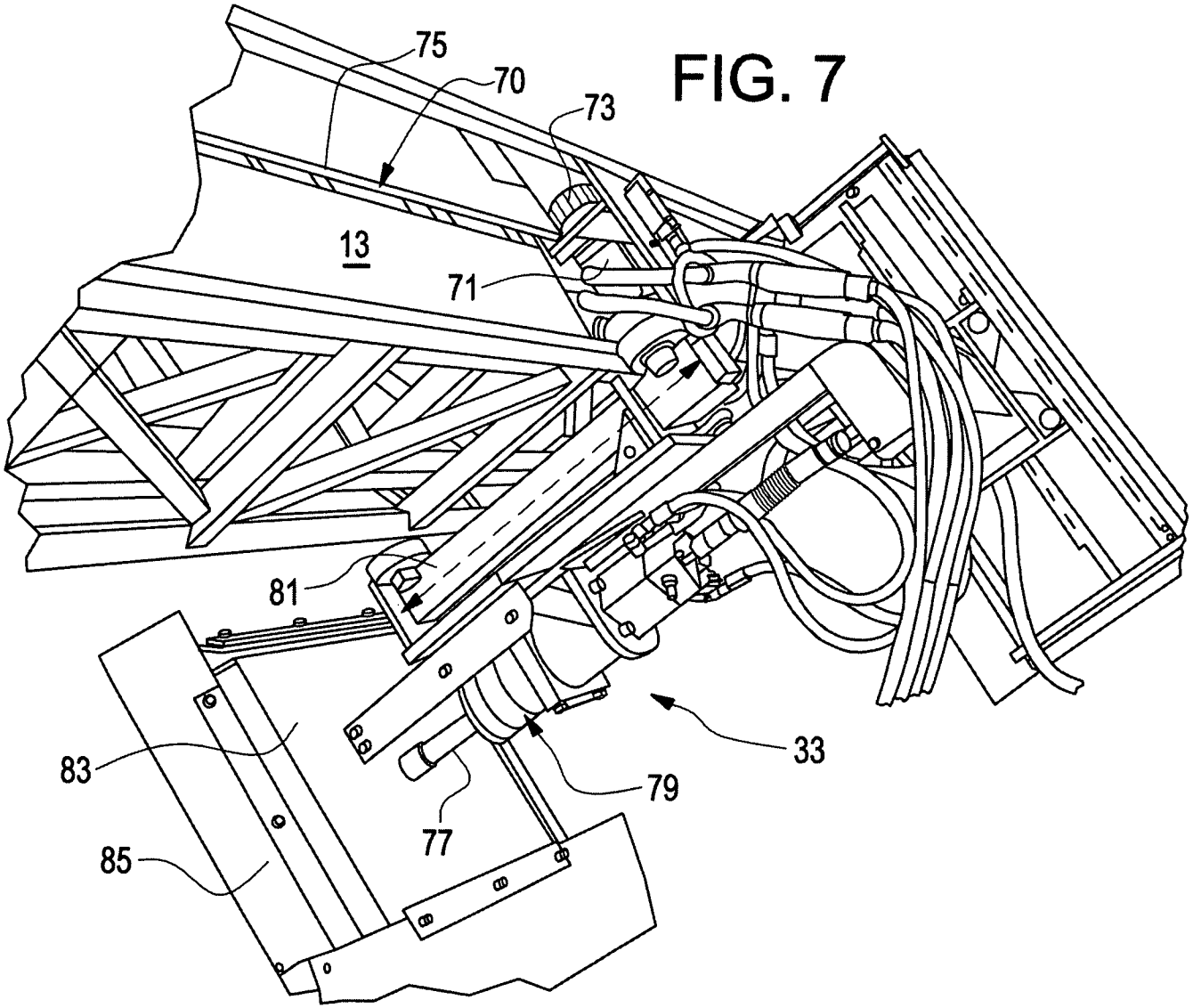
FIG. 7 shows a close-up perspective view of the carrier for the cutting nozzle and its actuators for various functions.

A cutting nozzle 30 is mounted on the outer boom section 13, and is coupled to the output shaft of a hydraulic motor 31 that facilitates rotation of the cutting nozzle 30 when the hydraulic motor 31 is activated. The cutting nozzle 30 with the hydraulic motor 31 are mounted on a carriage 33 (see FIG. 7, in particular) that will be explained in greater detail hereinbelow. As also seen in FIG. 7, the carriage 33 is movable along the longitudinal extent of the outer boom section so that the nozzle 30 may reciprocate back and forth while it is also rotating and spraying.

Figure 8:
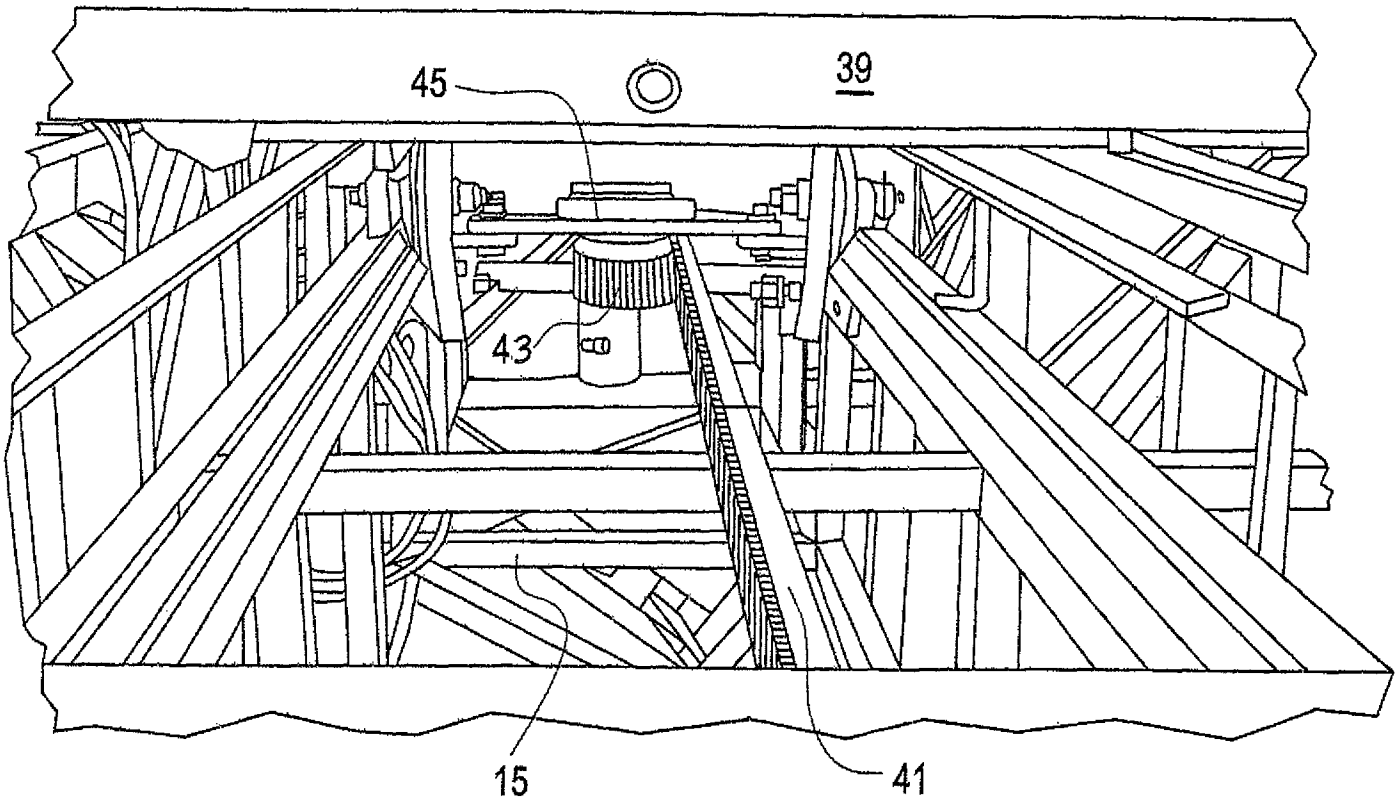
FIG. 8 shows an end view of the underside beneath the power pack showing the structure facilitating its traversal along its boom.

The further boom section 15 has mounted thereon a power pack 35 and a counterweight 37. The power pack 35 and counterweight 37 are mounted on a carriage 39 (FIG. 8) that may be reciprocated back and forth along the length of the further boom section 15 by virtue of a rack 41 coupled to a gear 43 driven by a hydraulic motor 45 on the carriage 39 (FIG. 8).

With reference back to FIG. 1, a walkway 49 is attached to the further boom section 15 and allows an operator to walk along it while operating and monitoring the inventive device 10.

Figure 3:
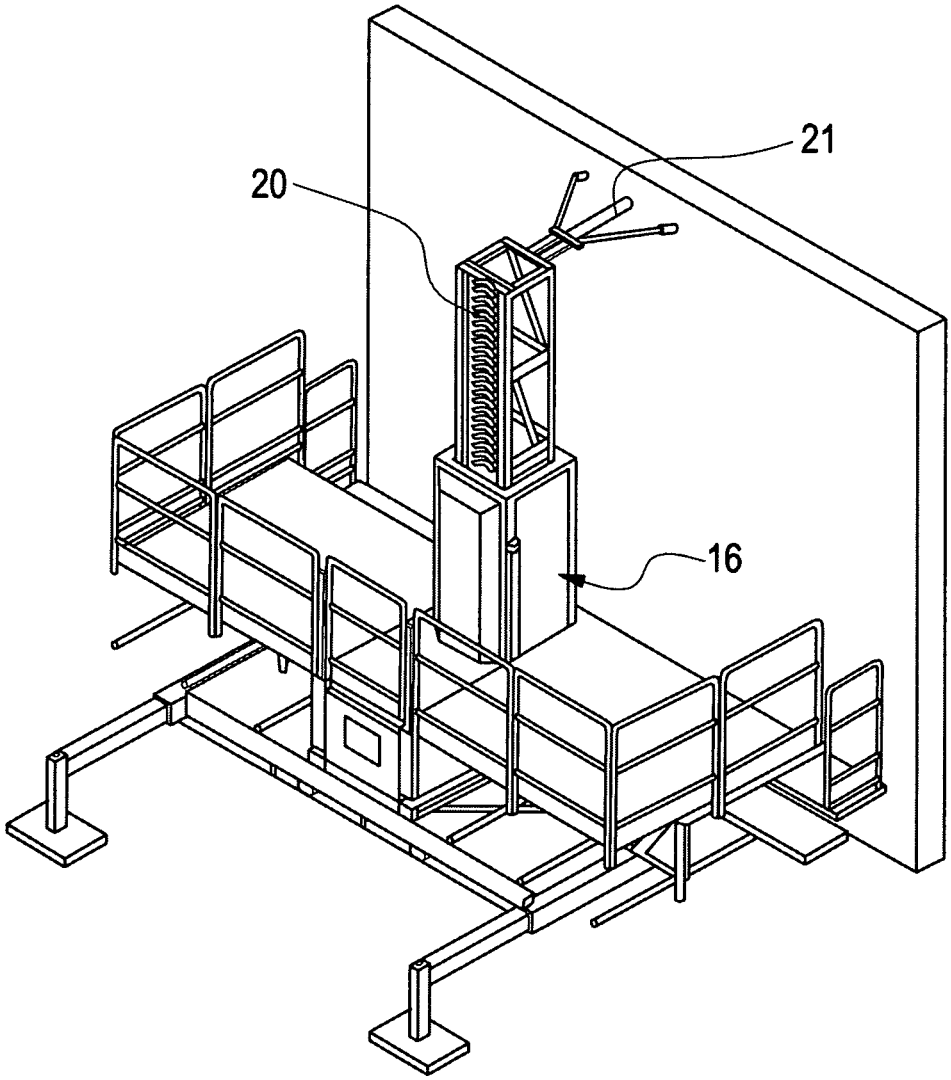
FIG. 3 PRIOR ART
FIG. 3 shows a perspective view of a hydraulic elevating platform known in the prior art and used in association with the present invention.

With reference to FIG. 3, details of the elongated tower 20, pedestal anchor 21, elevating platform 16 and elevating unit 23 are shown.

Figure 4:
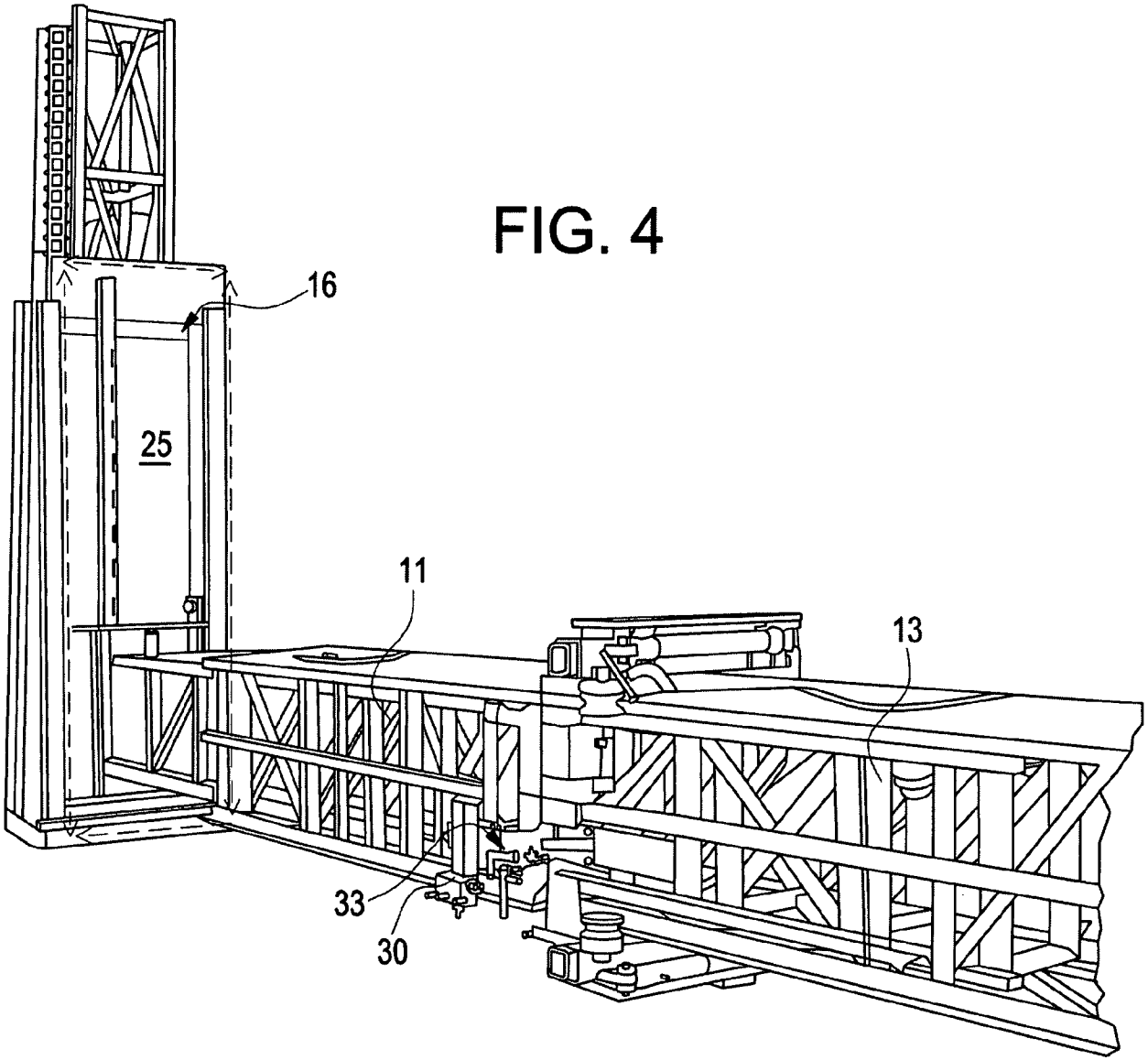
FIG. 4 shows a perspective view of the device showing the outer and inner boom structures and one side of the hydraulic elevating platform.

FIG. 4 shows the outer boom section 13, the inner boom section 11, and the side or face 25 of the elevating unit 23 to which the inner boom section 11 is releasably mounted. Also shown is the carriage 33 carrying the nozzle 30.

Figure 5:
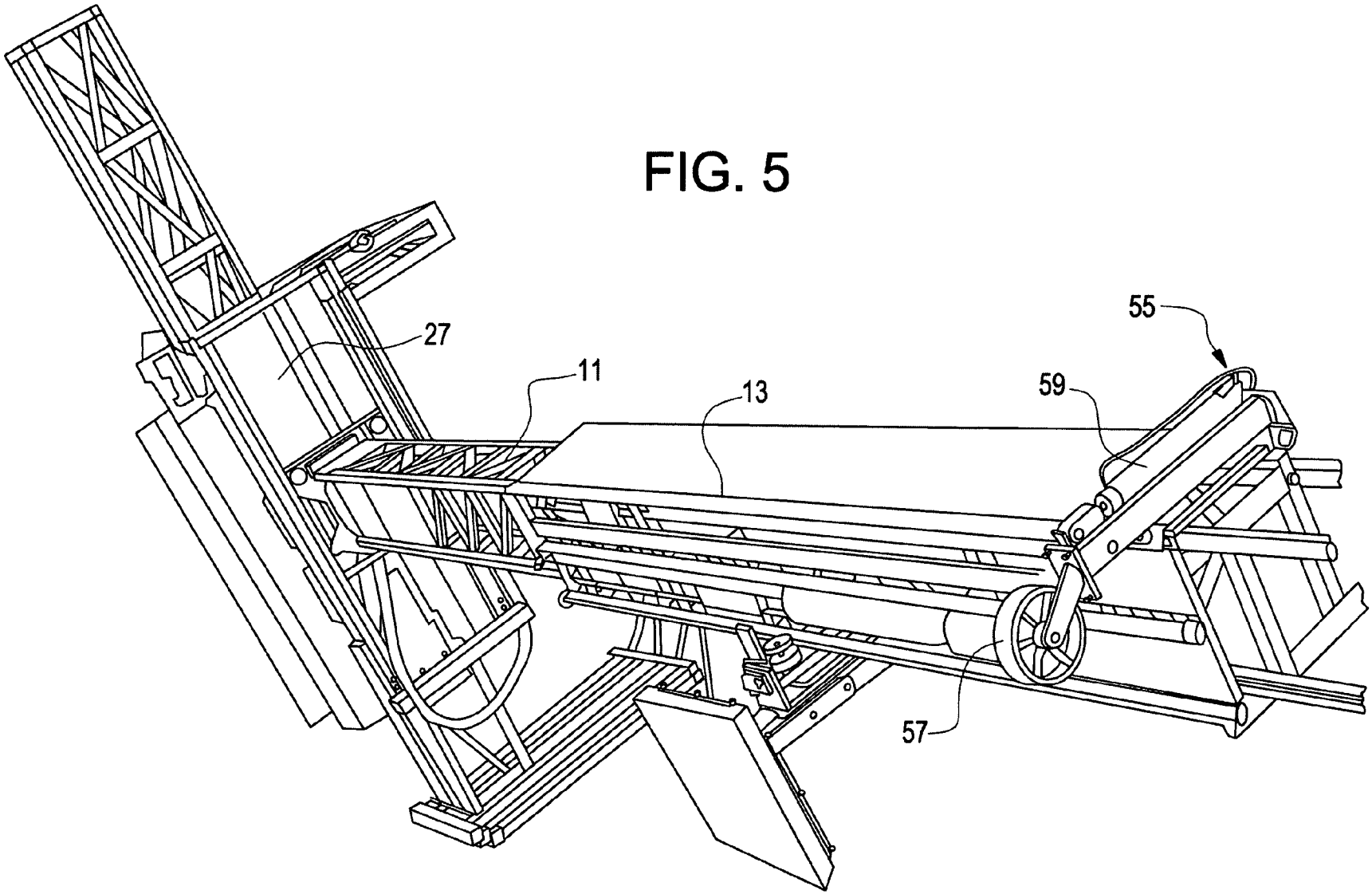
FIG. 5 shows a view similar to that of FIG. 4, but with the device pivoted upwardly to show the stabilizing roller and the cutting nozzle.

FIG. 5 shows the outer boom section 13, the inner boom section 11, the side or surface 27 of the elevating unit 23, and details of the coupling of the inner boom section 11 thereto. Those details are better seen with reference to FIG. 10 which shows rollers 50 mounted on the coupling 51 between the inner boom section 11 and the side surface 27 to permit the inner boom section 11 to ride up and down the surface 27.

With reference back to FIG. 5, a stabilizing roller mechanism 55 is provided including a roller 57 that may be reciprocated through the use of a hydraulic piston-cylinder 59. When the hydraulic piston-cylinder 59 is activated, the roller 57 is reciprocated out or in. The purpose for the stabilizing roller 57 is to stabilize the inventive device 10 when in use. Without the stabilizing roller 57, the extent of the inner boom section 11 and outer boom section 13 extend generally parallel to the wall surface that is being operated on by the device 10. However, there might be a tendency for the boom sections 11 and 13 to sway toward the wall structure in that configuration. The properly positioned roller 57 engages the wall surface and the roller 57 rotates as the device 10 is indexed up or down the wall structure to stabilize operations.

Figure 6:
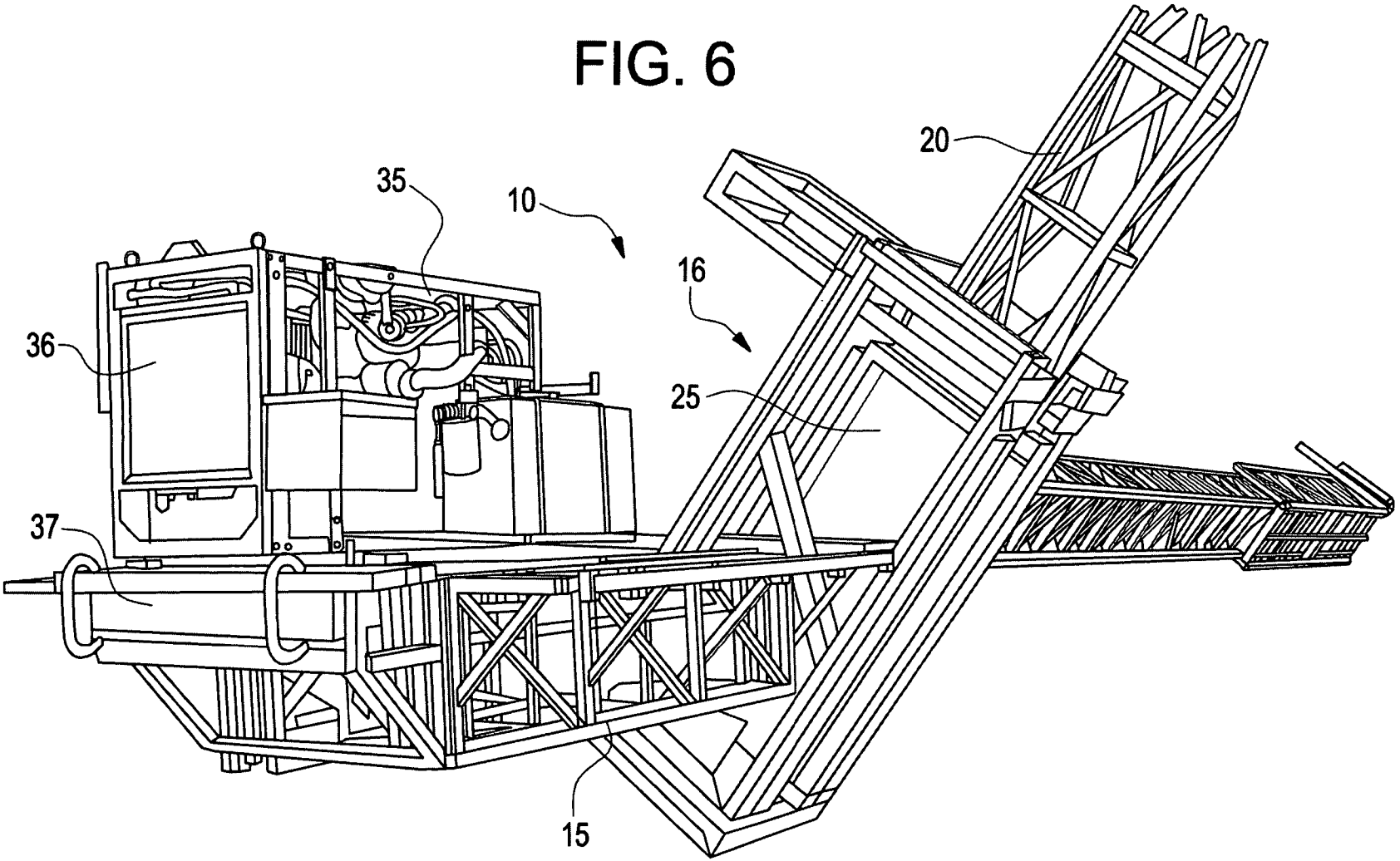
FIG. 6 shows a perspective view similar to that of FIG. 5, but from the opposite side showing the power pack and the beam on which it traverses.

FIG. 6 shows a further view of the further boom section 15 which carries the power pack 35 and the counterweight 37 via carriage 39. As shown in FIG. 6, the boom section 15 is mounted on the side wall 25 of the elevating unit 23. The elongated tower 20 is also shown in FIG. 6.

As earlier explained with reference to FIG. 8, the carriage 39 that carries the power pack 35 and counterweight 37 also caries the hydraulic motor 45 to which is coupled a drive gear 43 and meshed with the teeth of an elongated rack 41 directly mounted to the boom section 15. Thus, when the drive gear 43 is rotated in one direction or the other, the power pack 35 with the counterweight 37 mounted thereon is reciprocated back and forth, as the case may be, with respect to the further boom section 15.

There is an important reason why the power pack 35 and counterweight 37 are mounted for reciprocable movement with respect to the further boom section 15. In particular, as should be understood, the power pack 35 and counterweight 37 are extremely heavy and are sized to offset and balance the weight of the boom sections 11 and 13. The elevating unit 16, 23 must efficiently slide over the elongated tower 20 so that the device 10 can easily climb the tower 20. Thus, if there is a severe imbalance between the weight distribution of the boom section 15, power pack 35, and counterweight 37, on the one hand, and the boom sections 11 and 13, on the other hand, this can cause slight pivoting of the elevating unit 23 with respect to the fixed tower 20. This slight pivoting can cause the unit 23 to bind up on the elongated tower 20 and thereby preclude smooth movements with respect thereto. Thus, for example, as the outer boom section 13 is moved outwardly away from the elevating platform 16, the operator also moves the power pack 35 and counterweight 37 in the opposite direction away from the elevating unit 23 to balance the weight distribution to either side thereof. Conversely, as the outer boom section 13 is moved toward the elevating unit 23, the power pack 35 and counterweight 37 are moved toward the device 16 from the other side to effectuate balancing of the load and prevent binding of the unit 23 on the elongated tower 20. The intent is to maintain the center of gravity of the device 10 central of the elevating unit 23.

If desired, the inventive device 10 can be designed so that movements between the power pack and counterweight, on the one hand, and the outer boom section 13, on the other hand, are automatically coordinated to automatically maintain the invention device 10 in close to precise balance throughout its operating cycle. Such coordination may include a meter or gauge to measure imbalance and send control signals to the device that moves the power pack 35 and counterweight 37 and/or the outer boom section 13 to maintain the device 10 in balance. Alternatively, the speeds of the hydraulic motors moving the power pack 35 and counterweight 37, on the one hand, and the outer boom section 13, on the other hand, may be controlled responsive to sensing of conditions of imbalance. Alternatively, these movements may be controlled manually by an operator observing the interconnection between the elevating platform 16 and the elongated tower 20. Another approach is to design the gearing of the rack 41 and gear 43, on the one hand, and of the rack 61 and gear 65, on the other hand, so that the gear ratios thereof facilitate proportional movements of the power pack 35 and counterweight 37 with respect to concurrent movements of the outer boom section 13 to maintain balance of the device 10.

Figure 12:
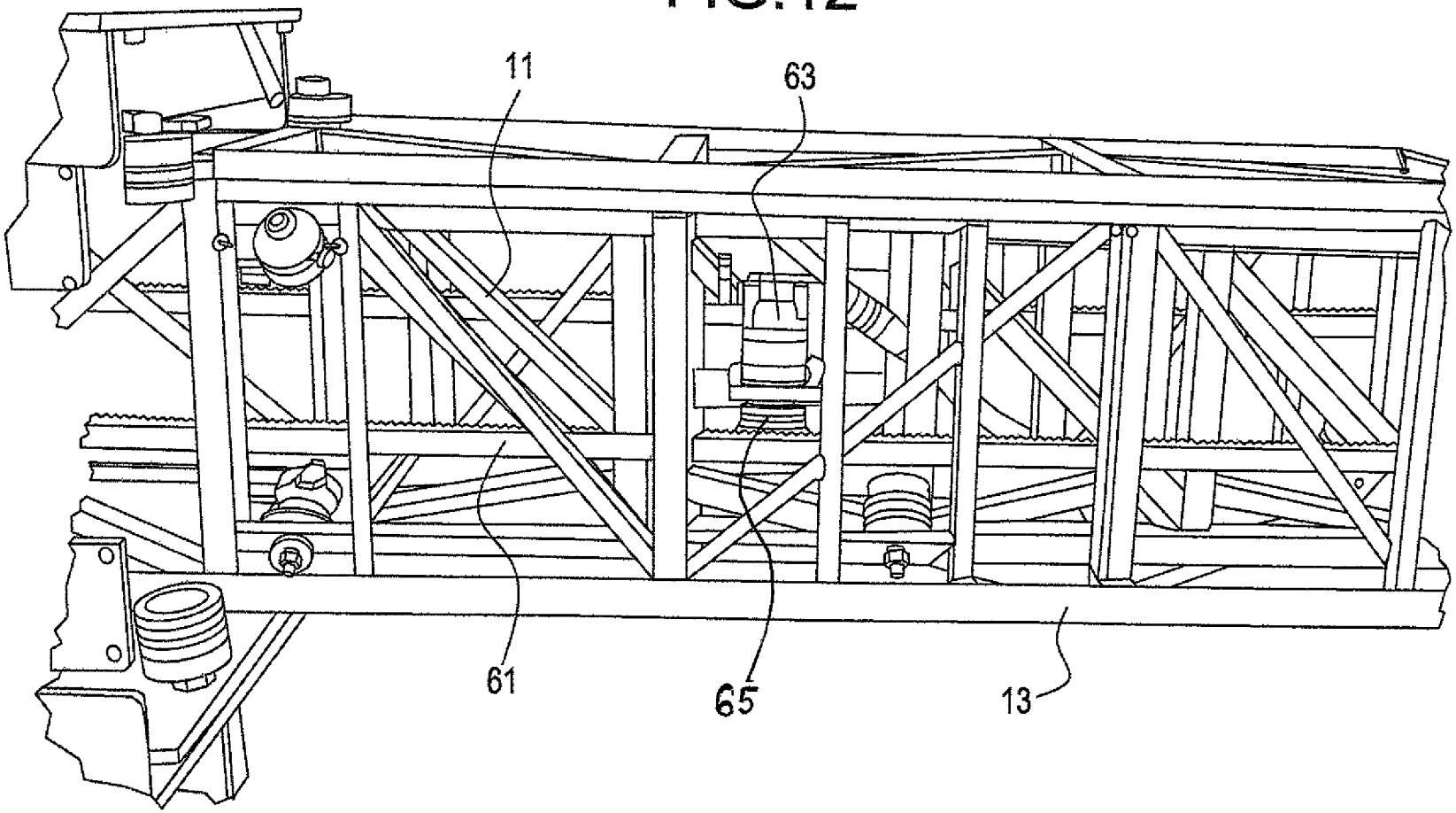
FIG. 12 shows a front view of a portion of the inner and outer boom sections showing the actuator to facilitate movements of the outer boom with respect to the inner boom.

FIG. 12 shows the outer boom section 13 and also shows the gear rack 61 mounted on the outer boom section 13 and the hydraulic motor 63 mounted on the inner boom section 11 and the gear 65 coupled to the drive shaft (not shown) of the hydraulic motor 63 and enmeshed with the gears of the gear rack 61 so that rotations of the gear 65 in one direction or the other result in reciprocation of the outer boom section 13 with respect to the inner boom section 11.

With reference to FIG. 7, the carriage 33 moving the nozzle 30 with respect to the outer boom section is shown. For this purpose, a gear rack 70 is mounted on the outer boom section 13 and a hydraulic motor 71 is carried by the carriage 33 and includes a gear 73 coupled to its drive shaft and enmeshed with the gear teeth 75 of the rack 70 so that rotations of the gear 73 result in reciprocation of the carriage 33 with respect to the outer boom section 13.

With further reference to FIG. 7, the nozzle is carried on the shaft 77 of the hydraulic motor 79 that rotates responsive to application of hydraulic pressure thereto to allow the nozzle to rotate. A piston-cylinder 81 is coupled between the outer boom section 13 and the carriage 33 and may reciprocate up to about 18 inches to allow the nozzle (not shown in FIG. 7) to move closer to the adjacent wall structure that is being treated or further away therefrom. The shaft 77 extends through a generally rectangular plate 83 that includes a plurality of rubber strips 85 about its periphery. The plate 83 and the strips 85 comprise a splash blocking mechanism that limits splash of water expelled from the nozzle 30.

Figure 9:
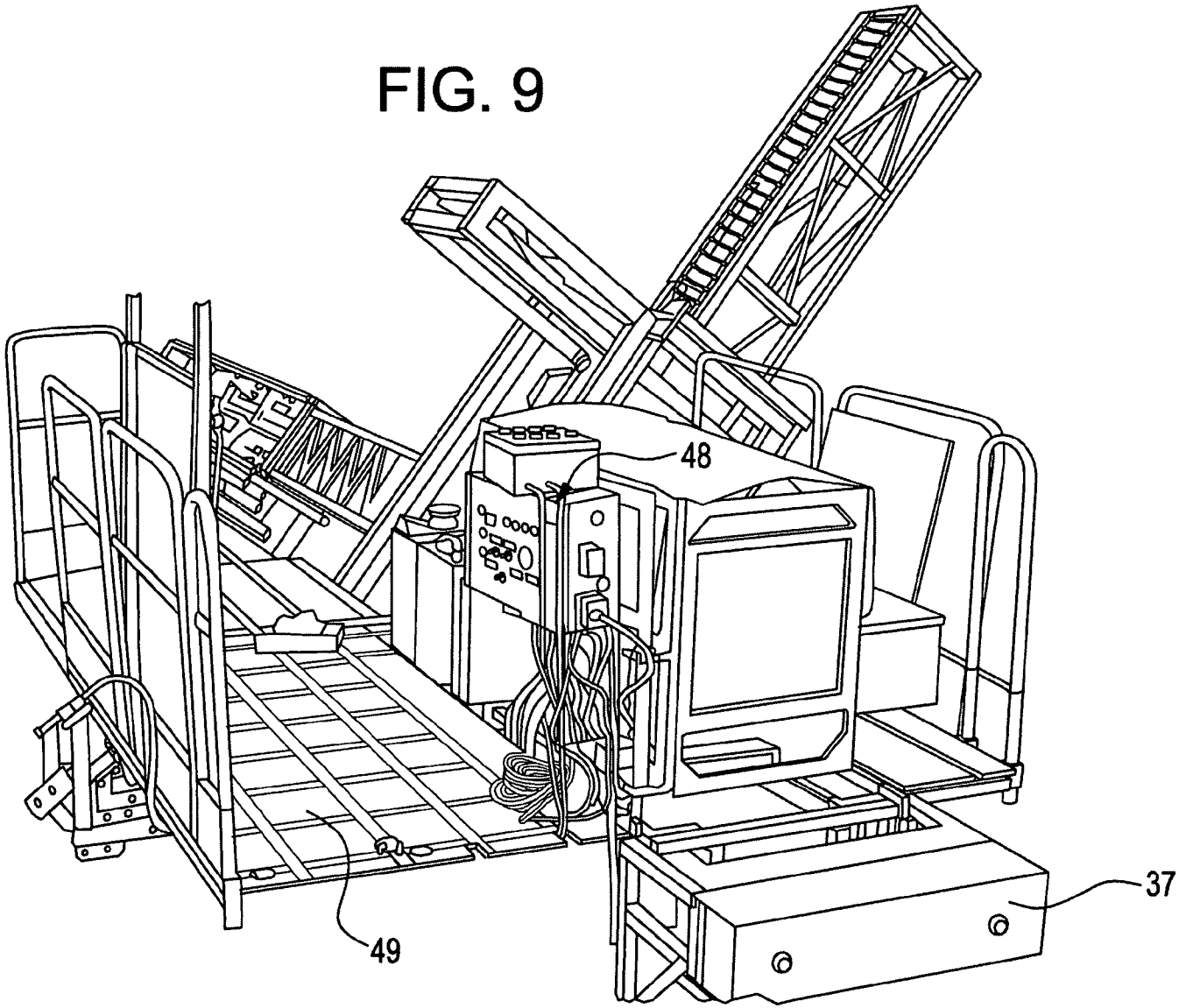
FIG. 9 shows a view above the view of FIG. 8 showing an operator catwalk along with the power pack and its counterweights.

FIG. 9 shows the operator walkway 49 as well as the counterweight 37 and a control panel 48 including numerous operator controls to control the various functions of the inventive system.

Figure 10:
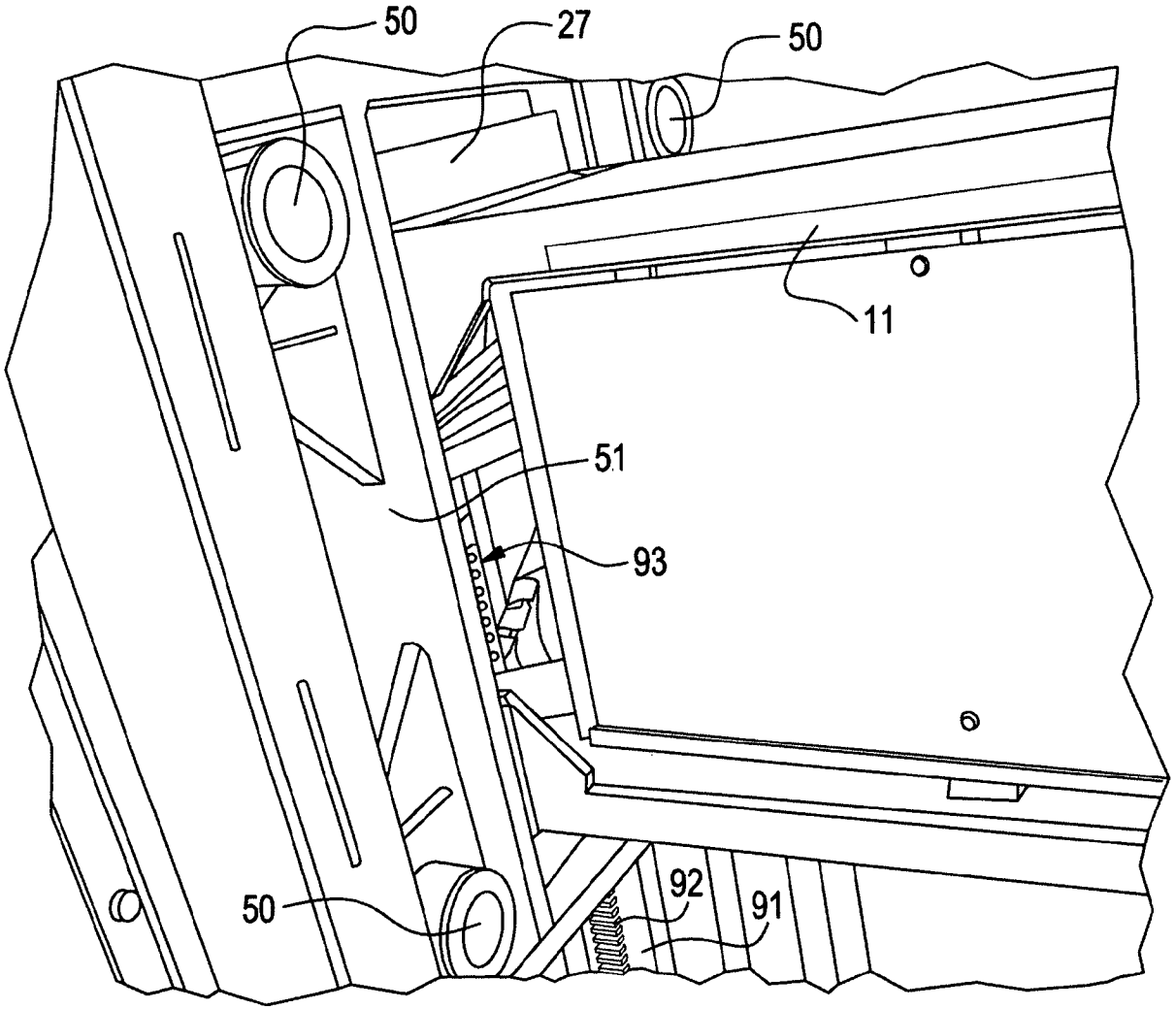
FIG. 10 shows a close-up view of the interconnection between the inner boom and the elevating platform showing how the inner boom can move vertically with respect to the elevating platform.
Figure 11:
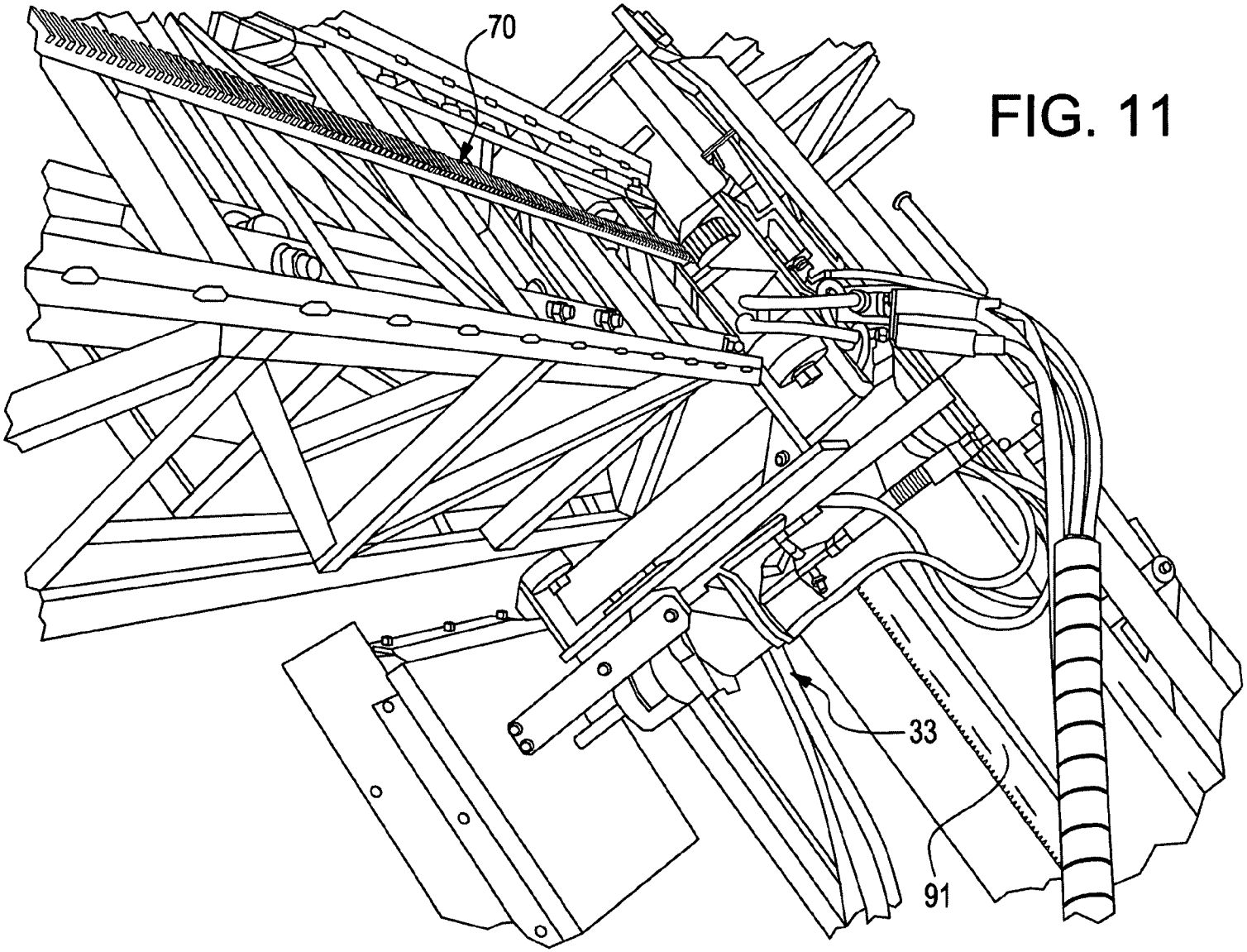
FIG. 11 shows a perspective view depicting more details concerning operation of the cutting nozzle and its carrier.

As explained earlier, the inventive device 10 includes means to facilitate moving the inner boom section 11 with respect to the wall 27 of the hydraulic elevating platform 16. FIG. 10 shows the rack 91 with its gear teeth 92. The hydraulic motor carried by the inner boom section 11 is located beyond the arrow designated with the reference numeral 93. FIG. 11 also shows the gear rack 91.

Figure 13:
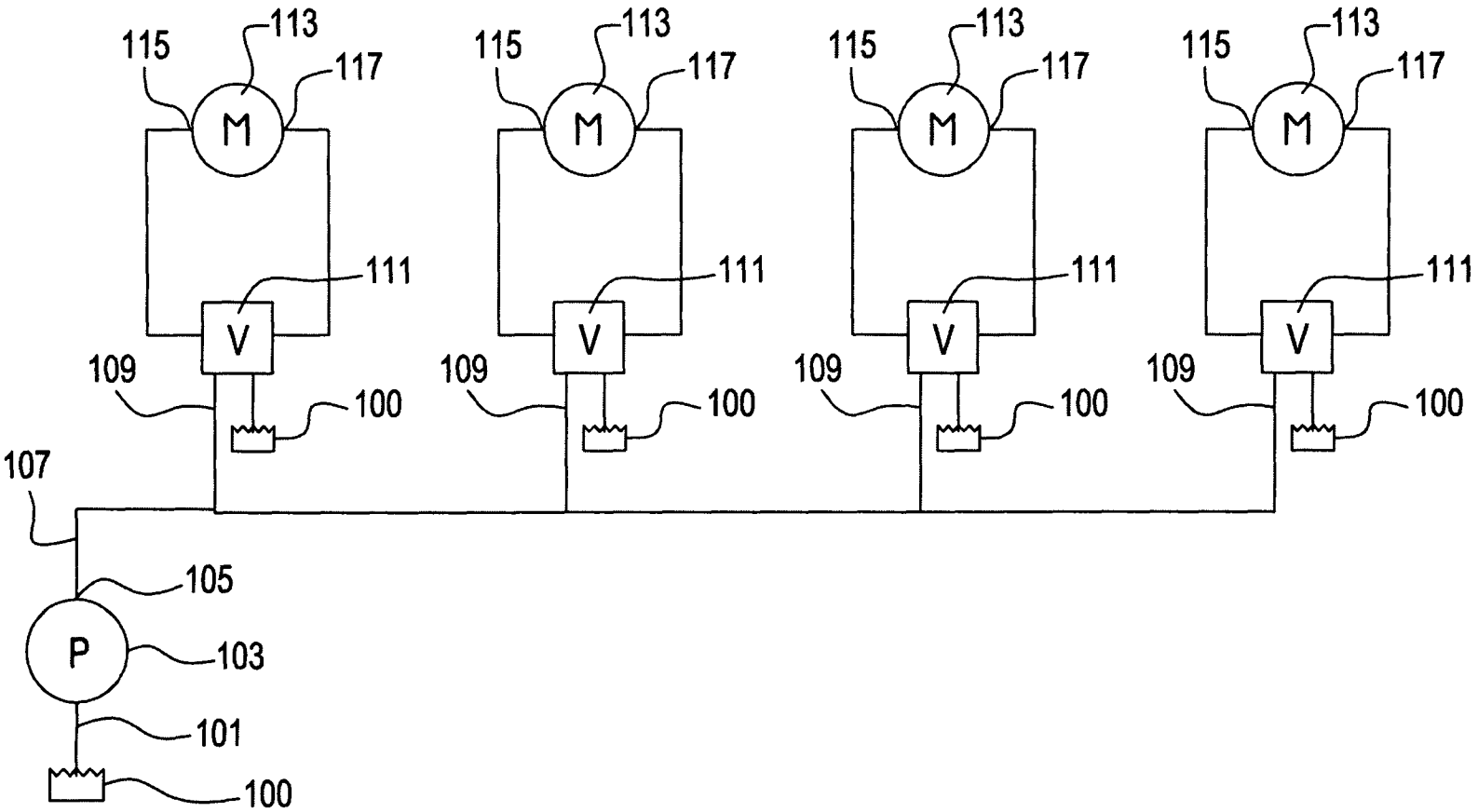
FIG. 13 shows a schematic representation of the hydraulic circuit of the present invention.

With reference to FIG. 13, a schematic representation of the hydraulic circuit of the present invention is shown. The circuit includes a sump 100 in which is inserted the intake 101 of a pump 103 having an outlet 105 through which hydraulic fluid is pumped at a high pressure.

An outlet passage 107 is connected to the outlet port 105 and directly connects with an input line 109 for each four port reversing valve 111. As is well known, in a four port reversing valve, the valve may be positioned to an off position precluding flow of hydraulic fluid, a second position in which hydraulic fluid flows in one direction, and a third position in which hydraulic fluid flows in the other direction. In either the second or third positions, the return line to the sump is connected into the hydraulic circuit.

As seen in FIG. 13, hydraulic motors 113 are hydraulically coupled to the four port reversing valves 111. Each motor is bidirectional in operation. In other words, it may rotate in either direction depending upon which direction the hydraulic fluid enters the motor. Thus, each motor has a first port 115 and a second port 117. In one direction of flow of fluid, the port 115 would be an inlet portion, and the port 117 would be an outlet port. When the four port reversing valve is moved to the position reversing the direction of flow, then the port 117 becomes the inlet and the port 115 becomes the outlet.

Four valve-motor combinations are shown in FIG. 13, but this is merely exemplary of the number of valve-motor combinations that are incorporated into the present invention. Each valve is represented by a control button on the control board of the power pack 35. Thus, there is a valve-motor combination for each function such as, movements of the outer boom section with respect to the inner boom section, movements of the carriage 33 with respect to the outer boom section 13, incremental movements of the inner boom section 11 with respect to the elevating unit 23, movements of the power pack 35 and counterweight 37 with respect to the further boom section 15, rotative movements of the nozzle 30, reciprocations of the stabilizing roller 57, reciprocations of the nozzle 30, and every other movement of any structure of the present invention.

The pump 103 is shown in FIG. 13 as a single pump. Of course, plural pumps may suitably be employed as well. The power pack 35 preferably includes a diesel engine to power the pumps of which its radiator 36 is seen in FIG. 6. As explained above, the elevating unit 23 is able to incrementally move up the elongated tower 20 step-by-step, with each step encompassing several inches. Additionally, as also explained above, the inner boom section 11 may move up and down with respect to the elevating unit 23. The mechanism for performing this function is seen with reference to FIGS. 4, 5 and 10, in particular. Thus, when it is desired to operate the inventive device 10, the inner boom section 11 is moved to the lowermost position with respect to the elevating unit 23 as seen in FIG. 4. The outer boom section 13 is reciprocated with respect to the inner boom section 11 while the carriage 33 reciprocates the nozzle 30 back and forth. For each position of the outer boom section 13 with respect to the inner boom section 11, for each sweep back and forth of the carriage 33, the inner boom section 11 is moved up with respect to the elevating unit 23 one incremental distance, typically related to the width of the swath of concrete removed by one pass of the nozzle 30. Once the inner boom section 11 has been moved incrementally with respect to the elevating unit 23 to the point where it is at the upper limit of its travel, the elevating unit 23 is moved upward with respect to the elongated tower 20, a distance equal to the height of the elevating unit 23, while the inner boom section 11 is moved downwardly to its lowermost point of travel with respect to the elevating unit 23. When this is completed, the process is repeated and this is done over and over again while the elevating unit 23 climbs the elongated tower 20.

As explained above, it is easy to reverse the mount of the elongated boom section 11 so that instead of being mounted on the face 25 of the hydraulic elevating platform 16, it is instead mounted on the face 27 thereof. In this way, based upon a single location of mounting of the elongated tower 20 on the surface of the wall being treated by the inventive device 10, the device 10 can remove concrete from up to 60 feet of width, 30 feet to each side of the elongated tower 20, before the elongated tower 20 must be moved to a new location.

As explained above, in order to prevent the hydraulic elevating platform 16 from binding on the tower 20, best efforts are made to maintain the balance of the inventive device 10 to either side of the elevating unit 23. For this purpose, the power pack 35 and counterweight 37 are mounted on a carriage movable with respect to the further boom section 15 so that as the outer boom section 13 is moved with respect to the inner boom section 11, weight balance can be maintained through movements of the power pack 35 and counterweight 37.

Although the invention is shown employing a single nozzle 30, multiple nozzles may also be employed. Each nozzle may rotate or oscillate as desired, and each nozzle may reciprocate with respect to the outer boom section 13 using a carriage such as the carriage 33.

If so desired, the nozzle 30 may be replaced by other devices operated through the use of hydraulic pressure. Such devices may include a sandblast nozzle, a wash down nozzle, a water spray bar for cleaning, painting nozzles or guns, a concrete saw, pneumatic hammers, or crack routers. The nozzles may rotate, may be straight, may comprise fan jet nozzles, or isolating nozzles.

The present invention may perform work on vertical or inclined surfaces and, as explained above, is capable of performing work as much as 30 feet laterally of the elongated tower 20. The ability of the power pack 35 and counterweight 37 to move to re-balance the weight of the device 10 facilitates the degree of extension that is accomplished, namely, up to 30 feet. Without the ability to provide weight balance, this would not be possible because the device 10 would be rendered unstable as the outer boom section 13 is moved away from the elevating unit 23.

As explained above, water under pressure sprayed from the nozzle 30 is supplied, preferably, by a separate trailer on which is contained large high pressure pumps connected to a source of water and which supply the nozzle through an elongated hose.

If desired, operation of the device may be automated as set up by an operator. As explained above, the movements of the carriage 33 in and out and the movements of the inner boom section 11 with respect to the hydraulic elevating platform 16 and the movements of the power pack 35 and counterweight 37 with respect to the further boom section 15 may be automatically synchronized as desired to best facilitate efficient removal of concrete from a wall surface, while at the same time ensuring that the weight distribution of the inventive device remains strictly in balance throughout to provide safety and to preclude binding on the elongated tower 20 which would preclude efficient movements of the device up and down.

With reference now to FIGS. 14-19, a second embodiment of the present invention is generally designated by the reference numeral 100. Many of the structures of the embodiment 100 are the same as those in the device 10, although their orientations may have changed as will be explained. Thus, structures that are the same as those in the first embodiment 10 are designated using like primed reference numerals.

Figure 14:
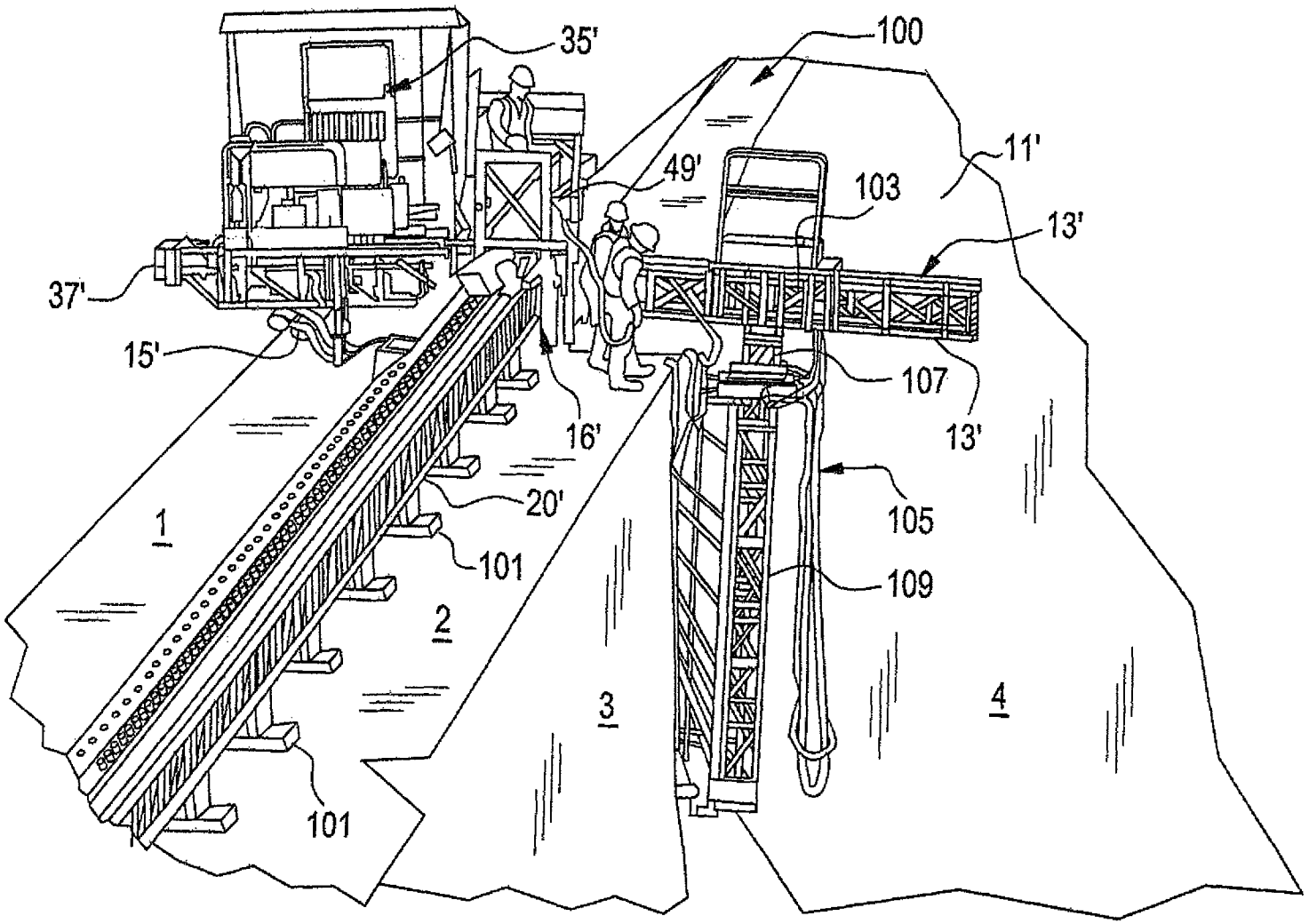
FIG. 14 shows a perspective view of a second embodiment of the present invention.
Figure 15:
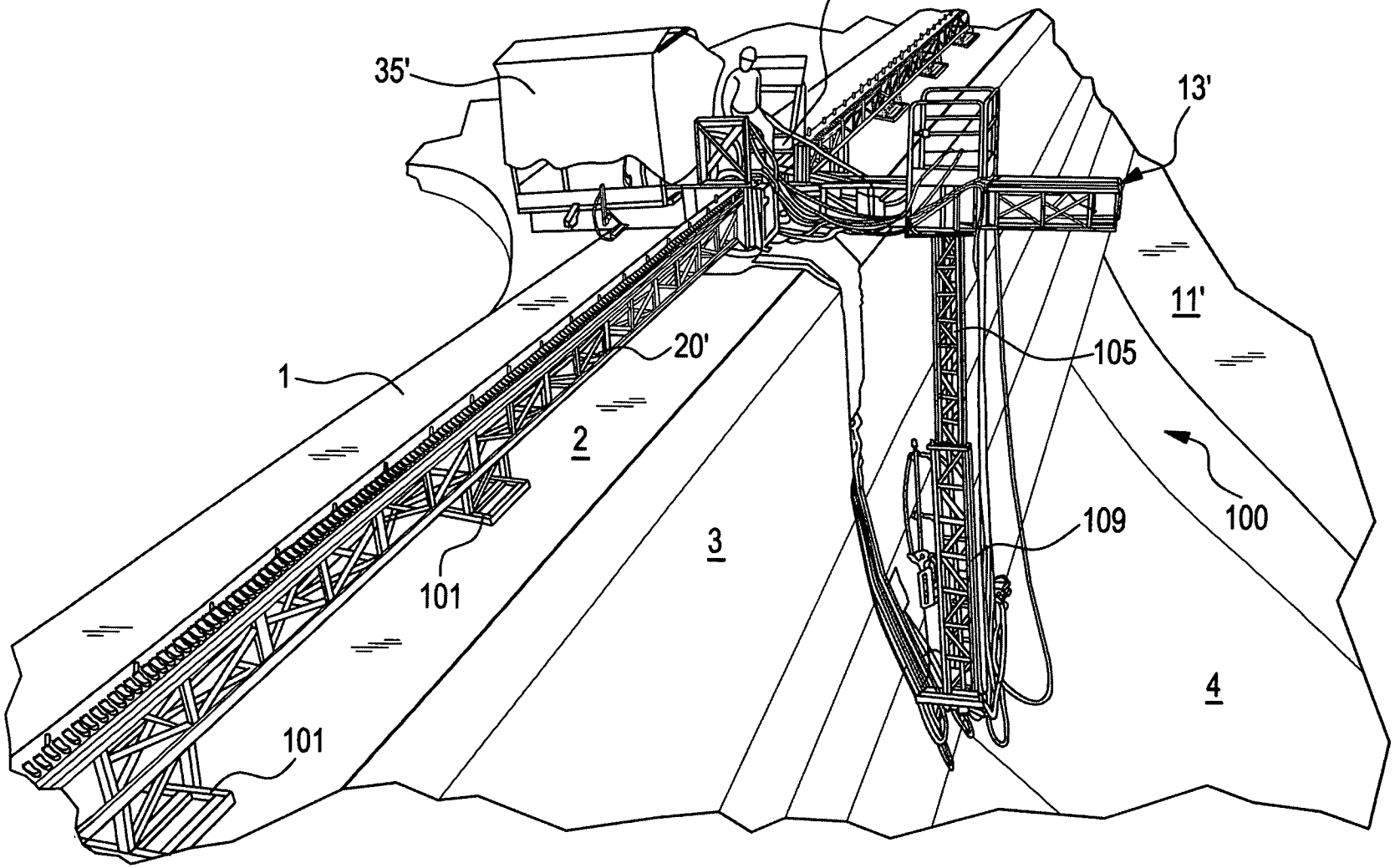
FIG. 15 shows a view similar to that of FIG. 14, but with the vertical extendible boom fully extended.

Reference is first made to FIGS. 14 and 15. Therein, a dam is generally designated by the reference numeral 1 and includes a top edge 2 and a generally vertical surface 3 followed by an angled surface 4. The tower section 20' is mounted horizontally on the top edge 2 of the dam 1 by a series of brackets 101 that include fasteners embedded in the concrete of the top edge 2. The inner boom section 11' and outer boom section 13' protrude past the edge 2 of the dam 1 out into space. The further boom section 15' extends in the opposite direction and includes the power pack 35', the counterweight 37', and the carriage 39' that carries the power pack 35' as well as the counterweights 37' and the operator walkway 49'. As should be understood from FIGS. 14 and 15, as compared to the embodiment of FIGS. 1-13, the boom sections 11', 13' and 15' are perpendicular to the surface 3 of the dam 1 and move with the platform 16' in a horizontal direction. This is to be compared with the embodiment of FIGS. 1-13 in which the tower section 20 is mounted vertically and the boom sections 11, 13 and 15 move vertically up and down the tower section 20.

As seen in FIGS. 14 and 15, the outer boom section 13 carries with it a bracket 103 from which downwardly depends another extendible boom generally designated by the reference numeral 105. The extendible boom 105 includes an inner boom section 107 connected to the bracket 103, and an outer boom section 109 that may reciprocate outward and inward with respect to the inner boom section 107 using the same mechanism by which the outer boom section 13' can extend and retract with respect to the inner boom section 11'. FIG. 14 shows the outer boom section 109 retracted while FIG. 15 shows the outer boom section extended to its full length.

Figure 16:
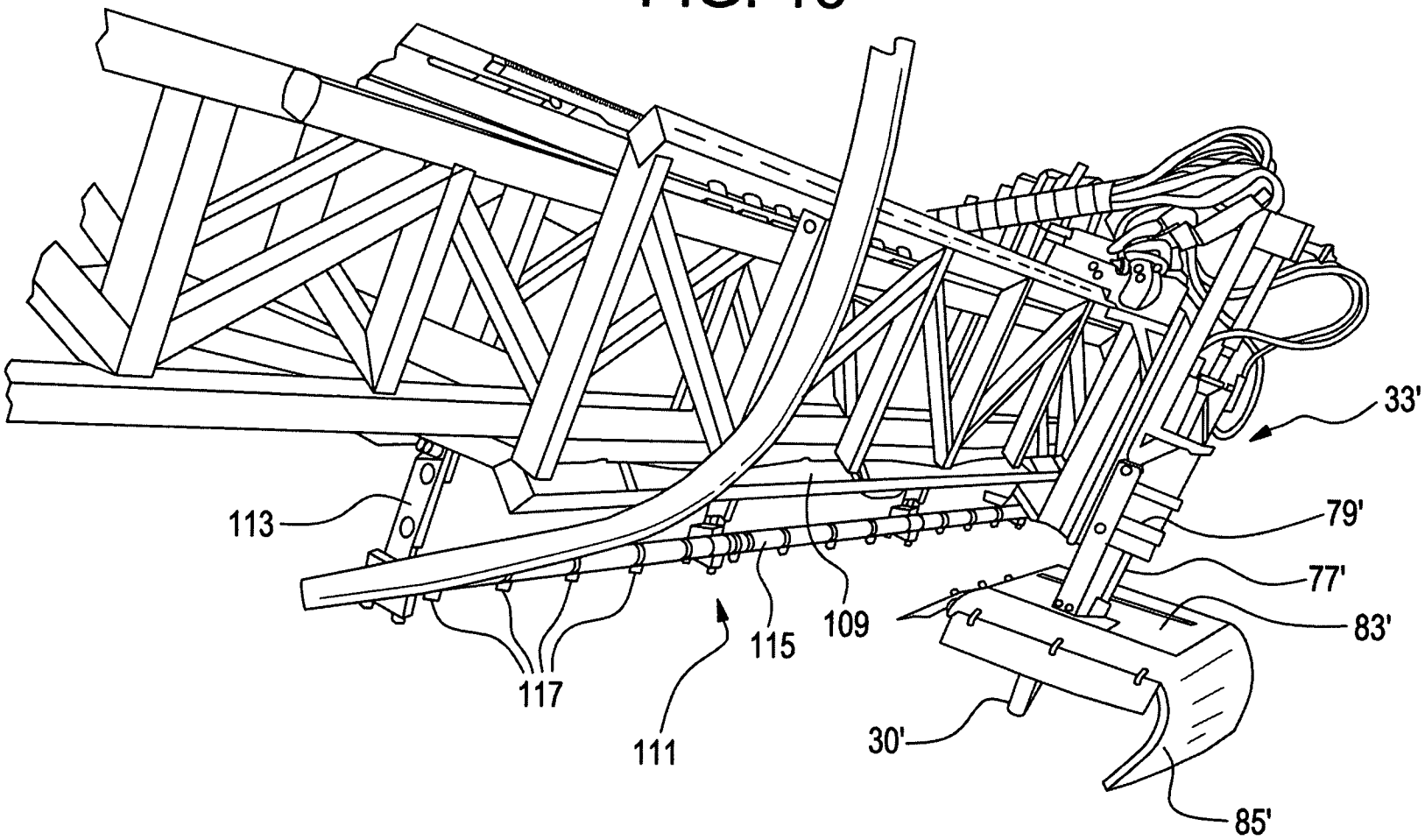
FIG. 16 shows a view looking down upon the extended vertical boom showing the use of an embodiment in which a manifold with a plurality of cutting nozzles is carried on the outer boom portion.

As seen in FIG. 16, the carriage mechanism 33' carries a cylinder 79' and a piston rod 77' as well as the plate 83' and strips 85' comprising a splash guard. The nozzle 30' is carried by the carriage 33' and this mechanism operates in the same manner as is the case with the carriage 33 and nozzle 30 of the embodiment of FIGS. 1-13. Also seen with particularity in FIG. 16 is a spray bar assembly 111 that is mounted on the outer boom section 109 with brackets including the bracket 113. This spray bar includes an elongated manifold 115 and a plurality of spray nozzles 117 from which high pressure water may be sprayed as shown in FIG. 16. While the spray bar 111 is fixed to the outer boom 109, it is able to move vertically along with vertical movements of the outer boom section 109.

Figure 17:
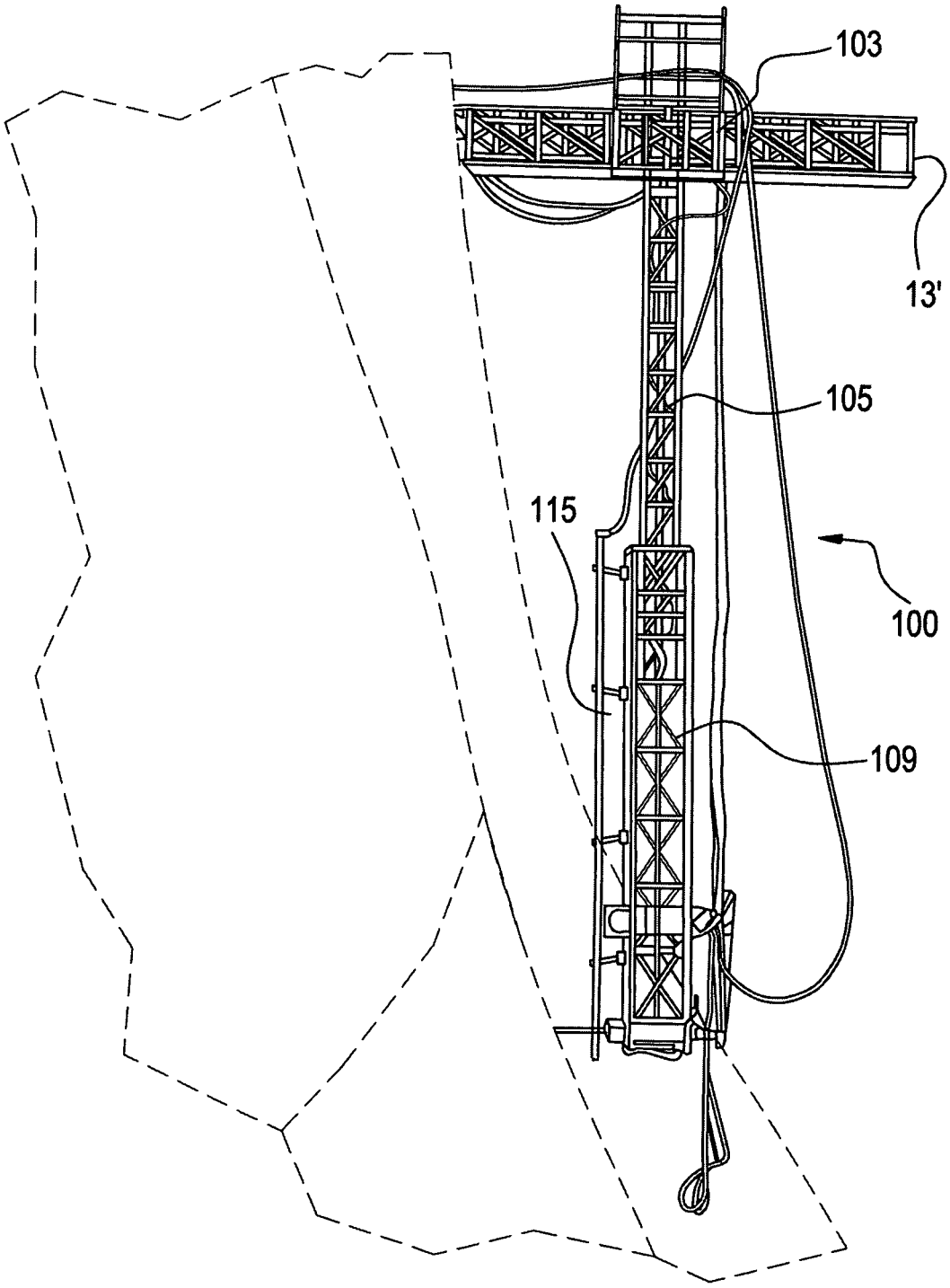
FIG. 17 shows a side view of the configuration shown in FIG. 16.

FIG. 17 shows a side view of the mechanism seen in FIG. 16 including the spray bar 111.

Figure 18:
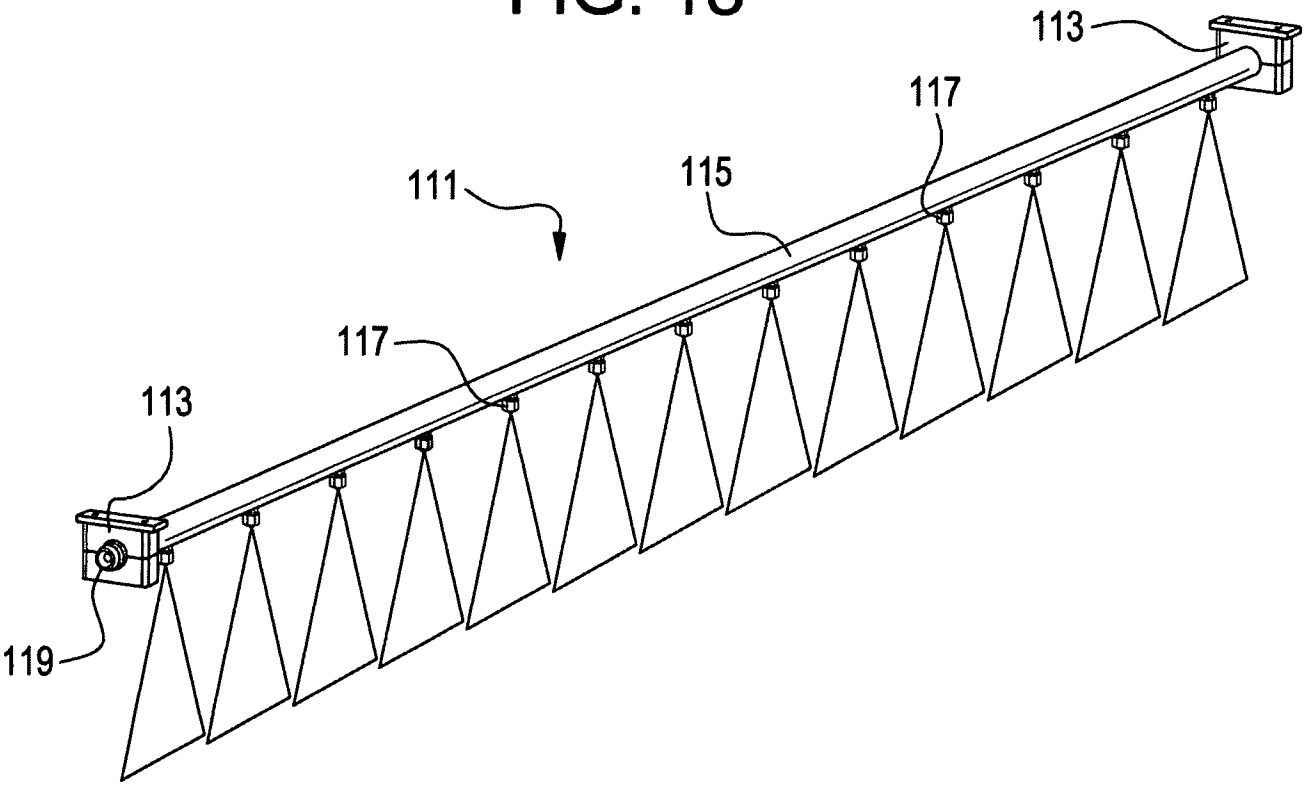
FIG. 18 shows a perspective view of the manifold and plurality of cutting nozzles.

FIG. 18 shows the spray bar 111, brackets 113, and nozzles 117. Also shown is a coupling 119 that enables the manifold 115 to be connected to a source of high pressure water or other material such as sand for sandblasting.

Figure 19:
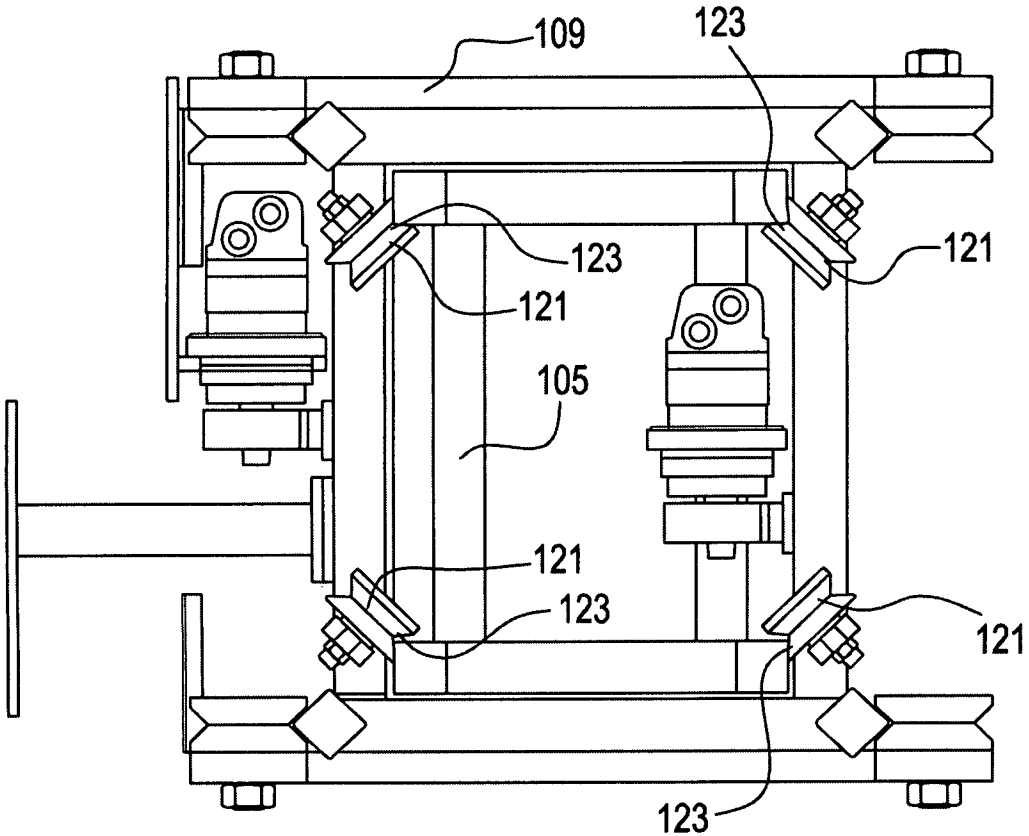
FIG. 19 shows an end view of the vertical extendible boom showing the manner by which the outer boom slides over the inner boom.

With reference to FIG. 19, the manner of movement of the outer boom section 109 with respect to the inner boom section 105 is seen. In particular, a plurality of pulley-like wheels 121 are mounted on corners of the boom section 109 and engage sharp edges 123 of the inner boom section 105 so that the outer boom section 109 can ride along the inner boom section 105 in an efficient and smooth manner.

In this second embodiment of the present invention, the hydraulic elevating platform 16' may incrementally move horizontally along the tower section 20' in its orientation shown in FIGS. 14-17, in particular, while the boom section 13' may move outwardly and inwardly with respect to the inner boom section 11'. While all of this is going on, the bracket 103 moves with the outer boom section 13' and the vertical boom section 109 may extend and retract with respect to the inner boom section 105. In this way, a lengthy vertical swath of the surface of the dam 1 may be treated with high water pressure as desired.

In the second embodiment of the present invention, the counterbalancing effect of the ability to move the power pack 35' and the existence of the counterweights 37' operate in the same fashion as is the case in the embodiment of FIGS. 1-13. For any given position of the bracket 103 with respect to the tower section 20', the position of the power pack 35' and the counterweight 37' is fixed. This is true regardless of the degree of extension of the boom section 109 with respect to the boom section 105. It is only when the bracket 103 as attached to the outer boom section 13' is reciprocated toward and away from the surface 3 of the dam 1 that counterbalancing movements of the power pack 35' and counterweights 37' must be carried out.

As such, an invention has been disclosed in terms of preferred embodiments thereof which fulfill each and every one of the objects of the invention as set forth above, and provide new and useful vertical or horizontal robots for hydrodemolition of concrete of great novelty and utility.

Of course, various changes, modifications and alterations in the teachings of the present invention may be contemplated by those skilled in the art without departing from the intended spirit and scope thereof.

As such, it is intended that the present invention only be limited by the terms of the appended claims.

The invention claimed is:

1. A hydrodemolition robot, comprising:

a) an elongated tower having first and second ends and on which is mounted an elevating platform, said elevating platform having first and second opposed sides and being movable on said tower from its first end to its second end;

b) a first boom connected to said first side of said platform, said first boom including a first boom section attached to said first side of said platform and a second boom section telescopically mounted on said first boom section;

c) a nozzle mounted on said second boom section and connected to a source of pressurized material;

d) a second boom connected to said second side of said platform opposite said first side and a carriage on said second boom movable between first and second ends of said second boom;

e) a power pack on said carriage and including controls for operation of said robot;

f) said carriage and power pack also comprising a counterweight to balance weight distribution of said robot to maintain a center of gravity of said robot at a location between said opposite sides of said platform, said carriage being moved toward or away from said tower in a direction opposite a direction of extension or retraction of said second boom section with respect to said first boom section and tower and based upon a degree of extension or retraction of said second boom section with respect to said first boom section to maintain said center of gravity of said robot at said location.

2. The robot of claim 1, wherein said elongated tower is mounted substantially vertically on a structure to be treated by material emanating from said nozzle.

3. The robot of claim 2, wherein said elevating platform is adapted to move vertically in incremental steps to climb said tower and descend said tower.

4. The robot of claim 3, wherein said first boom is connected to said elevating platform for vertical movement with respect to said elevating platform.

5. The robot of claim 1, further including a weight mounted on said carriage.

6. The robot of claim 1, wherein said nozzle is movable along said second boom section.

7. The robot of claim 6, wherein said nozzle is rotatably mounted on said second boom section.

8. The robot of claim 1, wherein said first and second booms are reversible, whereby said first boom may be connected to said second side of said platform and said second boom may be connected to said first side of said platform.

9. The robot of claim 1, wherein said elongated tower is mounted substantially horizontally on a structure to be treated by material emanating from said nozzle.

10. The robot of claim 9, wherein said elevating platform is adapted to move horizontally in incremental steps along said tower.

11. The robot of claim 9, wherein said second boom section includes a third boom mounted thereto including (a) a first boom section mounted to said second boom section of said first boom, and (b) a second boom section telescopically mounted on said first boom section of said third boom.

12. The robot of claim 11, wherein said nozzle is mounted on said third boom second boom section.

13. The robot of claim 12, wherein said nozzle comprises a manifold and a plurality of nozzles on said manifold.

14. The robot of claim 9, wherein said material is water.

15. The robot of claim 1, wherein said nozzle comprises a manifold and a plurality of nozzles on said manifold.

16. The robot of claim 1, wherein said nozzle is rotatably mounted on said second boom section.

17. A hydrodemolition robot, comprising:

a) an elongated tower having first and second ends and on which is mounted an elevating platform, said elevating platform having first and second opposed sides and being incrementally movable on said tower from its first end to its second end;

b) a first boom connected to said first side of said platform, said first boom including a first boom section attached to said first side of said platform and a second boom section telescopically mounted on said first boom section;

c) a nozzle movably mounted on said second boom section and connected to a source of pressurized water;

d) a second boom connected to said second opposed side of said platform and a carriage on said second boom movable between first and second ends of said second boom;

e) a power pack and weight on said carriage and said power pack including controls for operation of said robot;

f) said carriage, weight, and power pack also comprising a counterweight to balance weight distribution of said robot to maintain a center of gravity of said robot at a location between said opposed sides of said platform, said carriage being moved toward or away from said tower in a direction opposite a direction of extension or retraction of said second boom section with respect to said first boom section and tower and based upon a degree of extension of said second boom section with respect to said first boom section to maintain said center of gravity of said robot at said location.

18. The robot of claim 17, wherein said elongated tower is mounted substantially vertically on a structure to be treated by material emanating from said nozzle.

19. The robot of claim 17, wherein said elongated tower is mounted substantially horizontally on a structure to be treated by material emanating from said nozzle, said elevating platform being adapted to move horizontally in incremental steps along said tower.

20. The robot of claim 17, wherein said second boom section includes a third boom mounted thereto including (a) a first boom section mounted to said second boom section of said first boom, and (b) a second boom section telescopically mounted on said first boom section of said third boom, said nozzle being mounted on said third boom second boom section.

* * * * *